US010677243B2

(12) United States Patent
Bubb et al.

(10) Patent No.: US 10,677,243 B2
(45) Date of Patent: Jun. 9, 2020

(54) DISPLACEMENT PUMP WITH FORCED VENTING

(71) Applicant: ProMinent GmbH, Heidelberg (DE)

(72) Inventors: Alexander Bubb, Plankstadt (DE); Jens Kaibel, Lampertheim-Hofheim (DE); Tobias Völker, Sandhausen (DE)

(73) Assignee: ProMinent GmbH, Heidelberg (DE)

( * ) Notice: Subject to any disclaimer, the term of this patent is extended or adjusted under 35 U.S.C. 154(b) by 1180 days.

(21) Appl. No.: 14/383,622

(22) PCT Filed: Mar. 12, 2013

(86) PCT No.: PCT/EP2013/054976
§ 371 (c)(1),
(2) Date: Nov. 5, 2014

(87) PCT Pub. No.: WO2013/135681
PCT Pub. Date: Sep. 19, 2013

(65) Prior Publication Data

US 2015/0110654 A1 Apr. 23, 2015

(30) Foreign Application Priority Data

Mar. 13, 2012 (DE) ..... 10 2012 102 088

(51) Int. Cl.
*F04B 53/06* (2006.01)
*F04B 13/00* (2006.01)
(Continued)

(52) U.S. Cl.
CPC ..... *F04B 53/06* (2013.01); *F04B 7/0266* (2013.01); *F04B 13/00* (2013.01); *F04B 43/06* (2013.01)

(58) Field of Classification Search
CPC ..... F04B 53/06; F04B 7/0266; F04B 13/00; F04B 43/06
See application file for complete search history.

(56) References Cited

U.S. PATENT DOCUMENTS 1,151,329 A * 8/1915 Audett et al. ..... F23D 11/44 137/513.5
3,727,635 A * 4/1973 Todd ..... A01G 25/023 137/513.5
(Continued)

FOREIGN PATENT DOCUMENTS

DE 9101038 U1 4/1991
EP 1384895 A2 1/2004
(Continued)

OTHER PUBLICATIONS

Agnes Wittmann-Regis, International Search Report (English translation), Sep. 25, 2014.
(Continued)

*Primary Examiner* — Peter J Bertheaud
*Assistant Examiner* — Dnyanish G Kasture
(74) *Attorney, Agent, or Firm* — Paul and Paul

(57) ABSTRACT

A displacement pump includes a delivery chamber, connected to a pressure connection and a suction connection. A displacement element determines the volume of the delivery chamber and can be moved back and forth between a first position, in which the delivery chamber has a smaller volume, and a second position, in which the delivery chamber has a larger volume. The pressure connection is connected to the delivery chamber by a pressure valve and the suction connection is connected to the delivery chamber by a suction valve. The displacement pump is easy and economical to produce and simultaneously reliably provides a degassing function, whereby downtimes can be reduced and the reliability of the delivery process can be increased. With the pressure valve closed, a backflow channel connects the delivery chamber and pressure connection, through which medium can enter the delivery chamber and/or gas can escape from the delivery chamber.

20 Claims, 4 Drawing Sheets

Figure 1:
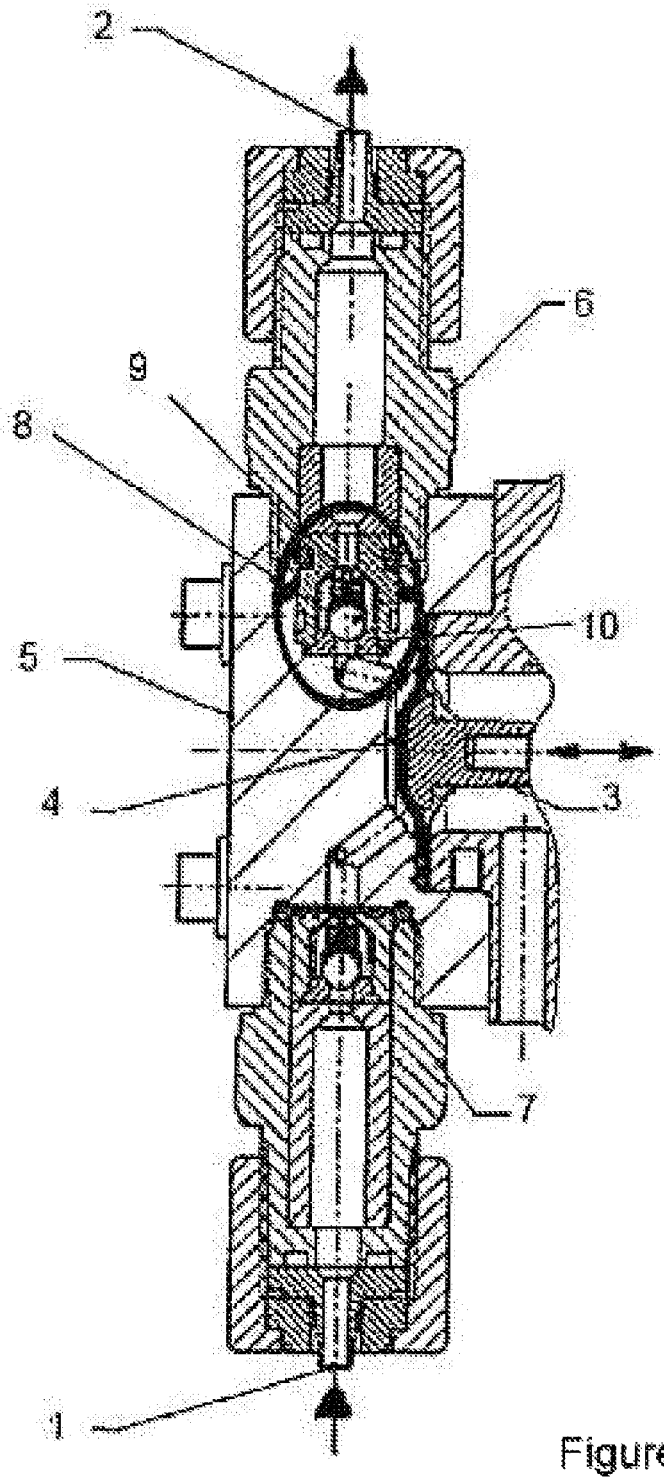

(51) Int. Cl.
*F04B 43/06* (2006.01)
*F04B 7/02* (2006.01)

(56) References Cited

U.S. PATENT DOCUMENTS

| | | | | |
|---|---|---|---|---|
| 5,261,447 | A * | 11/1993 | Boticki | G05D 16/163 137/493.2 |
| 6,065,940 | A | 5/2000 | Fleischer et al. | |
| 2004/0062662 | A1 | 4/2004 | Claude | |
| 2007/0031271 | A1 | 2/2007 | Claude | |
| 2008/0178948 | A1* | 7/2008 | Wilmshurst | F16K 15/04 137/513.5 |
| 2010/0232995 | A1 | 9/2010 | Claude | |
| 2011/0135514 | A1 | 6/2011 | Huhnke | |
| 2011/0247490 | A1* | 10/2011 | Mueller | F04B 53/06 95/26 |
| 2014/0119952 | A1 | 5/2014 | Adachi | |

FOREIGN PATENT DOCUMENTS

| | | | |
|---|---|---|---|
| JP | H01-49071 | A | 11/1990 |
| JP | 2005-282387 | A | 10/2005 |
| JP | 2011-147043 | A1 | 7/2011 |

OTHER PUBLICATIONS

Mr. Tatsuro Tominaga, Japanese Patent Office, Appln. No. 2014-561414, Examiner's Action, Dec. 13, 2016 (English Translation).

* cited by examiner

DISPLACEMENT PUMP WITH FORCED VENTING

CROSS-REFERENCE TO RELATED APPLICATION

This is a national stage 371 application of International Application No. PCT/EP2013/054976, filed Mar. 12, 2013.

The present invention relates to a displacement pump with a delivery chamber, which is connected to a pressure connection and a suction connection. The displacement pump furthermore has a displacement element determining the volume of the delivery chamber, which displacement element can be moved back and forth between a first position, in which the delivery chamber has a smaller volume, and a second position, in which the delivery chamber has a larger volume. The pressure connection is generally connected to the delivery chamber by a pressure valve and the suction connection is connected to the delivery chamber by a suction valve.

In order to deliver a medium, the displacement element is moved back and forth in an oscillating manner between the first and second position. Upon the movement of the displacement element from the first position into the second position, the volume of the delivery chamber is increased. If, as a result, the pressure in the delivery chamber drops below the pressure in a suction line connected to the suction connection, the suction valve opens and medium to be delivered is sucked into the delivery chamber via the suction connection. As soon as the displacement element moves from the second position in the direction of the first position again, i.e. the volume in the delivery chamber reduces, the pressure in the delivery chamber increases. The suction valve is closed in order to prevent the medium to be delivered flowing back into the suction line. As soon as the pressure in the delivery chamber exceeds the pressure in a pressure line connected to the pressure connection, the pressure valve is opened so the delivery medium located in the delivery chamber can be pressed into the pressure line.

A displacement pump of this type configured as a diaphragm pump is shown and described in EP 1 546 557 B1.

When metering liquids, in particular outgassing delivery media, such as, for example, sodium hypochlorite (NaClO), air bubbles can form in the suction line connected to the suction connection and be sucked into the metering head. It is also possible for air bubbles to form in the delivery chamber. This is often the case after relatively long metering breaks, for example after a weekend. As the suction connection is connected to a suction line, which in the simplest case is configured as a hose and ends in a storage container, it may occur when the storage container is exchanged, in particular when the pump is running, that the suction line is briefly no longer connected to the delivery medium and sucks in air.

If too much gas is located in the metering head of an oscillating delivery pump, disruptions of the metering process may occur if the metering head's own compressibility is not sufficient due to the enclosed gas volume to open the pressure valve against the return spring, the closing body's own weight and the system pressure. In other words, it may occur that when the gas proportion in the delivery chamber becomes too high, the pressure in the delivery chamber does not increase sufficiently, despite the movement of the displacement element from the second into the first position, to open the pressure valve connected to the pressure connection. The reason for this is the high compressibility of gas in comparison to liquids.

If, therefore, the displacement element no longer succeeds in applying an adequately high pressure to open the pressure valve, the delivery medium is not pumped, i.e. the desired metering cannot take place.

In order to be able to depart from this faulty state, it is necessary to restore the compressibility to the counter-pressure present at the pressure connection. This can take place in that some liquid is introduced into the delivery chamber again in order to again improve the ratio of compressible media to incompressible media in such a way that the pressure built up by the movement of the delivery element can again reach the counter-pressure present at the pressure connection.

In the delivery pump shown in EP 1 546 557 B1, an additional connection is therefore provided between the delivery chamber, on the one hand, and the pressure connection, on the other hand, which is opened intermittently in order to allow liquid re-entry from the pressure line into the delivery chamber, whereby gas can simultaneously escape from the delivery chamber so that the ratio between compressible gases and incompressible liquids can be improved again and, in the ideal case, the counter-pressure present at the pressure connection can be reached again in the delivery chamber.

However, this solution is relatively expensive, as, in addition to an additional bypass line, a valve closing the latter and an activation device to activate the valve have to be provided.

Proceeding from the described prior art, it is therefore the object of the present invention to provide a displacement pump, which is simple and economical to produce and simultaneously reliably provides a degassing function, whereby downtimes can be reduced and the reliability of the delivery process can be increased.

This object is achieved according to the invention in that, when the pressure valve is closed, a backflow channel connects the delivery chamber and pressure connection to one another, through which delivery medium can flow back from the pressure line into the delivery chamber and/or gas can escape from the delivery chamber into the pressure line.

In other words, even with the pressure valve closed, a small backflow channel is opened, through which delivery medium can flow back from the pressure line connected to the pressure connection into the delivery chamber. In the same way, gas can escape from the delivery chamber via the backflow channel into a pressure line connected to the pressure connection. The backflow channel is therefore used both for the backflow of medium and also for the outflow of gas (degassing).

This backflow ensures that gas optionally present in the delivery chamber is compressed and is at least partially flushed from the delivery chamber.

This connection reduces the efficiency and therefore the pumping performance of the displacement pump a little.

However, this can be accepted as long as it is ensured that the loss of delivery performance due to the provision of the backflow channel is small in comparison to the delivered volume.

It is therefore provided in a preferred embodiment that the backflow channel, at its narrowest point, has a cross-section that is smaller than 0.5 $mm^2$, preferably smaller than 0.1 $mm^2$ and at best smaller than 0.03 $mm^2$. It basically applies that the smaller the cross-section of the backflow channel, the smaller is the loss of delivery performance because of the presence of the backflow channel.

On the other hand, the backflow channel has to be in a position to guide an adequate quantity of liquid from the pressure line connected to the pressure connection into the delivery chamber.

It is therefore provided in a preferred embodiment that the backflow channel, at its narrowest point, has a cross-section that is greater than 0.005 $mm^2$, preferably greater than 0.01 $mm^2$ and at best greater than 0.015 $mm^2$. These values are advantageous, in particular in the case of low-pressure pumps with a counter-pressure of up to 20 bar and when using aqueous delivery media. At higher counter-pressures, smaller cross-sections may be advantageous. Larger cross-sections may be advantageous in the case of delivery media with a higher viscosity.

Tests have namely shown that cross-sections that are too small can frequently be clogged by impurities, whereby the desired backflow or degassing function is prevented.

Basically, the backflow channel can be arranged as desired, in which case care should preferably be taken that the end of the backflow channel connected to the delivery chamber is as far as possible arranged in the upper region of the delivery chamber in order to ensure that gas possibly located in the delivery chamber is flushed out via the backflow channel.

In a preferred embodiment, the backflow channel is arranged in the pressure valve so the expensive provision of a bypass connection is dispensed with.

The pressure valve generally has a valve body and a valve seat, it being possible for the valve body to be moved back and forth between an open position, in which the valve body does not come into contact with the valve seat and the delivery chamber is connected to the pressure connection, and a closed position, in which the valve body comes into contact with the valve seat. The valve body may, for example, consist of a ball, which is pressed into the valve seat with or without the aid of a spring. If the pressure in the delivery chamber is greater than the sum of the spring force, the weight force applied by the valve body and the force applied by the medium located in the pressure line on the valve body, the ball is pressed out of the valve seat so an annular gap opens between the ball, on the one hand, and the valve seat, on the other hand, through which annular gap the delivery medium can be pumped out of the delivery chamber into the pressure line.

In a preferred embodiment it is now provided that the valve seat or valve body are configured in such a way that the backflow channel is formed between the valve seat and valve body in the closed position.

In other words, the connection between the delivery chamber, on the one hand, and the pressure line, on the other hand, even when the valve body is seated in the valve seat, is not completely closed, but a small backflow channel remains open.

A backflow channel of this type can be realised, for example, by a bore through the valve seat or the valve body.

In another example, the valve body, on its face coming into contact with the valve seat, may have a groove, which is arranged in such a way that the groove forms the backflow channel in the closed position.

Alternatively or in combination with this, the valve seat may have a sealing face, which is arranged in such a way that the valve body comes into contact with the sealing face in the closed position and does not come into contact with the sealing face in the open position, the sealing face having a groove, which is arranged in such a way that the groove forms the degassing connection between the delivery chamber and the pressure connection in the closed position.

This embodiment can also be easily realised in already existing displacement pumps in that a corresponding groove is merely introduced into the sealing face of the valve seat.

It has been shown that the groove at best has a depth that is smaller than 0.2 mm, preferably smaller than 0.1 mm and at best between 0.01 and 0.09 mm.

Basically, the groove may have any desired cross-section, such as, for example, rectangular or triangular. However, the best results have been achieved if the groove has a curved groove base. The groove base preferably has a radius of curvature that is smaller than 1 mm, preferably smaller than 0.5 mm and at best between 0.15 mm and 0.4 mm.

Obviously, a plurality of valves may also be arranged in a row one behind the other.

Figure 2:
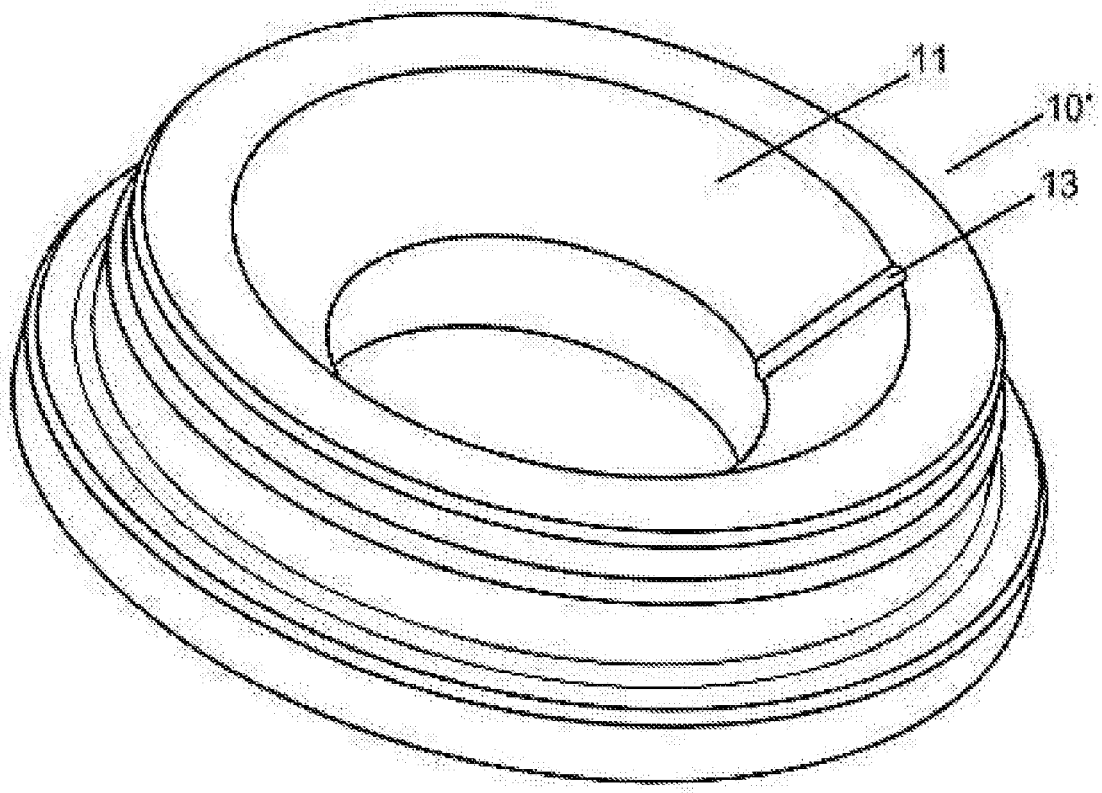
Figure 3:
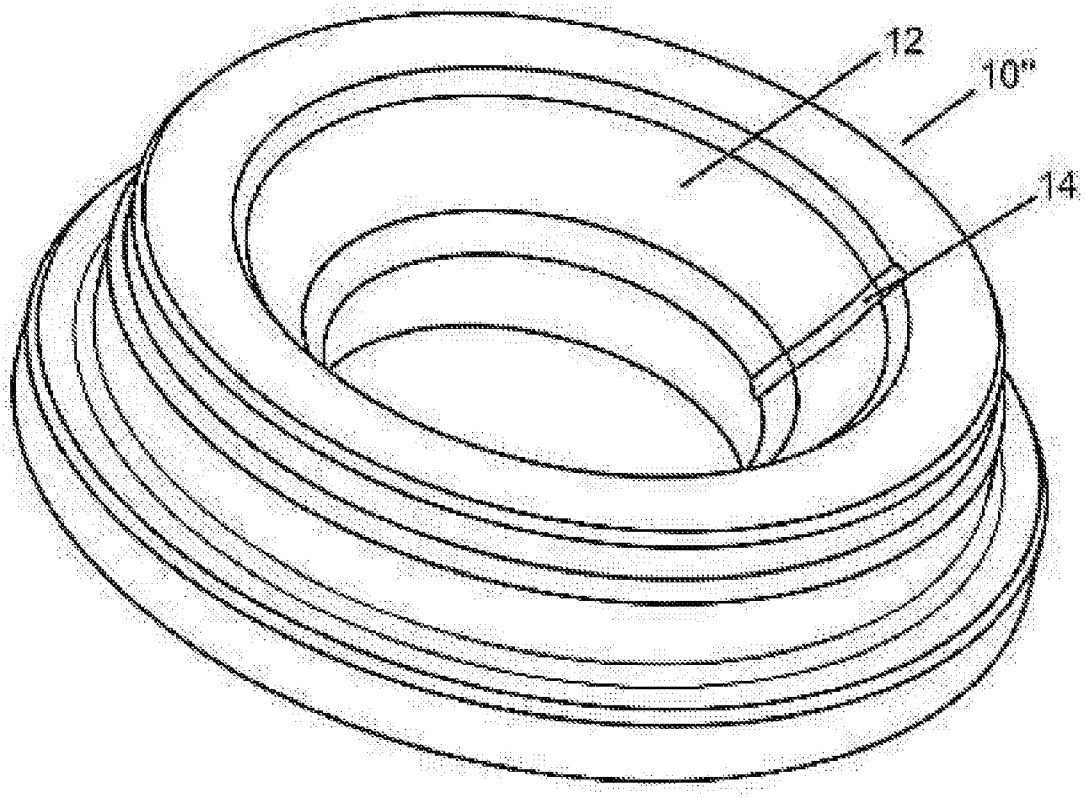
Figure 4:
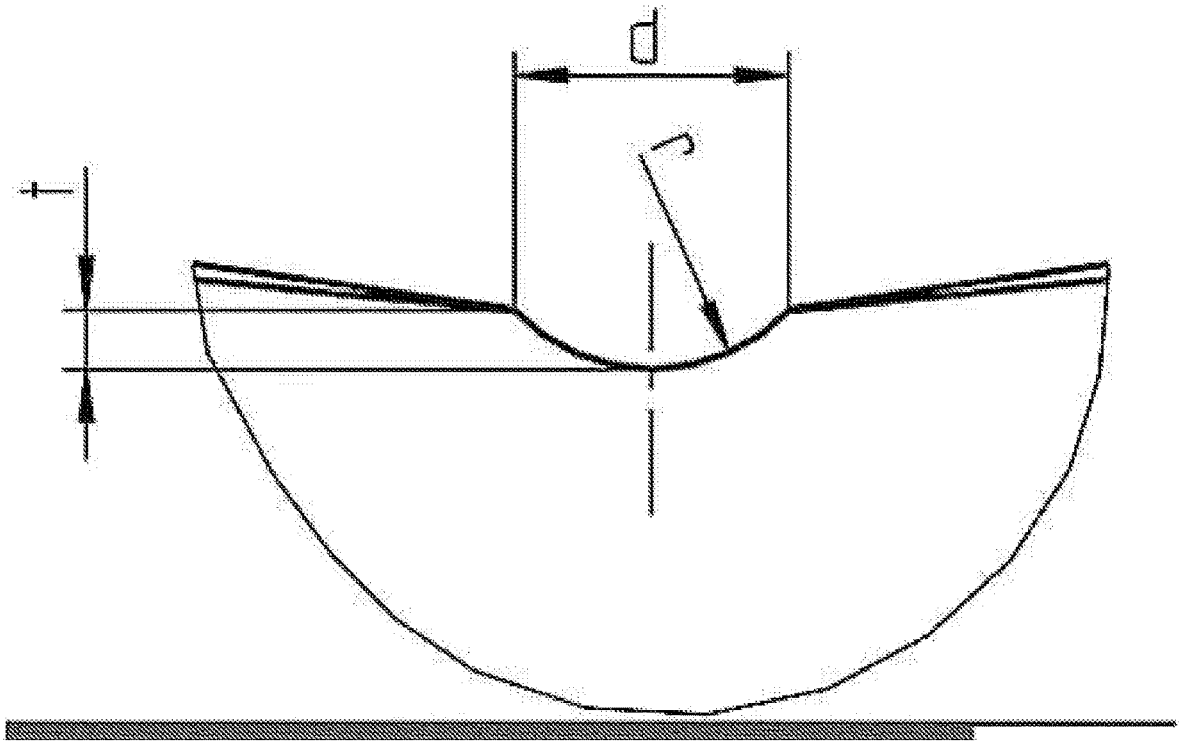

Further advantages, features and application possibilities of the present invention become clear with the aid of the following description of preferred embodiments, in which:

FIG. 1 shows a cross-section through a metering head with ball valves of the prior art, FIG. 2 shows a perspective view of a first embodiment of a valve seat according to the invention, FIG. 3 shows a second embodiment of a valve seat according to the invention and FIG. 4 shows a partial cross-section through the valve seat of the first embodiment.

FIG. 1 shows a cross-sectional view through a metering head 5 of the prior art. The metering head 5 has a delivery chamber 4, the volume of which is fixed by the delivery element 3 configured as a metering diaphragm. This metering diaphragm 3, as indicated by the double arrow, can be moved back and forth between two positions, whereby the volume of the delivery chamber 4 can be varied. The delivery chamber 4 can be connected, on the one hand, by the suction valve 7 to a suction line 1 and, on the other hand, can be connected by the pressure valve 6 to a pressure line 2. The pressure valve 6 has a valve seat 10, against which a ball 8 configured as a valve body is pressed by means of a spring element 9. As an alternative to this, the valve element could also be pressed against the valve seat by means of its weight force. The suction valve connected to the suction line is constructed in the same manner.

If, in a first step, the metering diaphragm in FIG. 1 is now moved to the right, i.e. the volume of the delivery chamber 4 is increased, the pressure in the delivery chamber firstly drops until the pressure in the suction line is greater than the pressure in the delivery chamber. The suction valve 7 then opens so delivery medium is sucked out of the suction line into the delivery chamber 4. If the movement of the diaphragm 3 is now reversed, i.e. the volume in the delivery chamber 4 is reduced again, the pressure in the delivery chamber 4 increases and the suction valve 7 is closed to prevent delivery medium being pressed back from the delivery chamber 4 into the suction line 1. As soon as the pressure in the delivery chamber 4 is greater than the pressure in the pressure line, the ball 8 is pressed against the spring force 9, the inherent weight of the ball 8 and the force applied by the medium located in the pressure line on the valve ball out of the valve seat 10, so an opening exists between the delivery chamber 4 and pressure line 2, through which the delivery medium can be transported from the delivery chamber into the pressure line 2.

Delivery medium can thus be metered from the suction line into the pressure line by an oscillating movement of the metering diaphragm 3.

If air or another gas is inadvertently sucked in via the suction line or if an outgassing medium is delivered, gas may have formed in the delivery chamber 4, in particular after a relatively long downtime of the pump.

As gases, in contrast to liquids, can be compressed, it may then occur that, despite the oscillating movement of the metering diaphragm 3, the pressure in the delivery chamber 4 no longer increases so sharply that the pressure valve 6 opens against the counter-pressure prevailing in the pressure line. In a situation such as this, no delivery medium can be delivered.

It is then necessary to again transport delivery medium into the delivery chamber 4 or to remove the gas located therein from the delivery chamber in order to restore the mode of functioning of the pump.

Two embodiments of valve seats 10' and 10" according to the invention are therefore shown in FIGS. 2 and 3. These valve seats can be used at the position of the valve seat 10 shown in FIG. 1. The valve seats have sealing faces 11, 12, the valve seat having a conical sealing face in the first embodiment shown in FIG. 2, while the valve seat has a spherically formed sealing face 12 in the second embodiment shown in FIG. 3.

It is obvious that the sealing faces of the valve seat accordingly have to be configured corresponding to the shape of the valve body 8.

According to the invention, the valve seat now has a groove 13, 14, which preferably extends through the entire sealing face. This groove ensures that even when the sealing body 8 rests on the sealing face 11, 12 of the valve seat 10', 10", a backflow channel is provided by the groove, through which delivery medium can flow to a small extent from the pressure connection back into the delivery chamber 4, whereby the gas possibly located therein can escape.

In the embodiments shown in FIGS. 2 and 3, the grooves 13, 14 bridge the sealing faces 11, 12 by the shortest way. Depending on the application, however, the groove may also bridge the sealing face by a non-direct way, for example spirally. In addition, a plurality of grooves may obviously be provided, which do not necessarily all have to be arranged in the valve seat, but could, for example, also be arranged on the outside of the valve body 8.

A cross-section through the groove 13 of the first embodiment of FIG. 2 is shown in FIG. 4. It is seen that the groove has a curved groove base with a radius r of curvature, so a groove width d and a groove depth t are produced. The groove width d is preferably selected to be in the region between 0.15 and 0.5 mm.

The invention claimed is:

1. Displacement pump with a delivery chamber, which is connected to a pressure connection and a suction connection, a displacement element determining the volume of the delivery chamber, said displacement element being able to be moved back and forth between a first position, in which the delivery chamber has a smaller volume, and a second position, in which the delivery chamber has a larger volume, wherein the pressure connection is connected to the delivery chamber by a pressure valve and the suction connection is connected to the delivery chamber by a suction valve, characterised in that with the pressure valve closed, a backflow channel connects the delivery chamber and pressure connection, through which medium can enter the delivery chamber and/or gas can escape from the delivery chamber, and in that the backflow channel, at its narrowest point, has a cross-section that is smaller than 0.5 $mm^2$.

2. Displacement pump according to claim 1, characterised in that the backflow channel, at its narrowest point, has a cross-section that is greater than 0.005 $mm^2$.

3. Displacement pump according to claim 1, characterised in that the backflow channel, at its narrowest point, has a cross-section that is smaller than 0.1 $mm^2$.

4. Displacement pump according to claim 1, characterised in that the pressure valve has the backflow channel.

5. Displacement pump according to claim 4, characterised in that the pressure valve has a valve body and a valve seat, wherein the valve body can be moved back and forth between an open position, in which the valve body does not come into contact with the valve seat and the delivery chamber is connected to the pressure connection, and a closed position, in which the valve body comes into contact with the valve seat, the valve seat or valve body being configured in such a way that, in the closed position, the backflow channel is formed between the valve seat and the valve body.

6. Displacement pump according to claim 5, characterised in that the valve body has a groove, at the face of the valve body coming into contact with the valve seat, which is arranged in such a way that the groove forms the backflow channel in the closed position.

7. Displacement pump according to claim 5, characterised in that the valve seat has a sealing face, which is arranged in such a way that the valve body comes into contact with the sealing face in the closed position and does not come into contact with the sealing face in the open position, the sealing face having a groove, which is arranged in such a way that the groove forms a degassing connection between the delivery chamber and pressure connection in the closed position.

8. Displacement pump according to claim 6, characterised in that the groove has a depth that is smaller than 0.2 mm.

9. Displacement pump according to claim 6, characterised in that the groove has a curved groove base, the groove base having a radius of curvature that is smaller than 1 mm.

10. Displacement pump according to claim 2, characterised in that the backflow channel, at its narrowest point, has a cross-section that is greater than 0.01 $mm^2$.

11. Displacement pump according to claim 10, characterised in that the backflow channel, at its narrowest point, has a cross-section that is greater than 0.015 $mm^2$.

12. Displacement pump according to claim 3, characterised in that the backflow channel, at its narrowest point, has a cross-section that is smaller than 0.03 $mm^2$.

13. Displacement pump according to claim 8, characterised in that the groove has a depth that is smaller than 0.1 mm.

14. Displacement pump according to claim 13, characterised in that the groove has a depth that is between 0.01 and 0.09 mm.

15. Displacement pump according to claim 9, characterized in that the groove base has a radius of curvature that is smaller than 0.5 mm.

16. Displacement pump according to claim 15, characterized in that the groove base has a radius of curvature that is between 0.15 mm and 0.4 mm.

17. Displacement pump according to claim 6, characterised in that the valve seat has a sealing face, which is arranged in such a way that the valve body comes into contact with the sealing face in the closed position and does not come into contact with the sealing face in the open position, the sealing face having a groove, which is arranged in such a way that the groove in the sealing face forms a degassing connection between the delivery chamber and pressure connection in the closed position.

18. Displacement pump according to claim 7, characterised in that the groove has a depth that is smaller than 0.2 mm.

19. Displacement pump according to claim 7, characterised in that the groove has a curved groove base, the groove base having a radius of curvature that is smaller than 1 mm.

20. Displacement pump according to claim 8, characterised in that the groove has a curved groove base, the groove base having a radius of curvature that is smaller than 1 mm.

* * * * *